United States Patent [19]

Herchenroeder et al.

[11] 4,439,248

[45] Mar. 27, 1984

[54] METHOD OF HEAT TREATING NICRALY ALLOYS FOR USE AS CERAMIC KILN AND FURNACE HARDWARE

[75] Inventors: Robert B. Herchenroeder, Kokomo; George Y. Lai, Carmel, both of Ind.

[73] Assignee: Cabot Corporation, Kokomo, Ind.

[21] Appl. No.: 345,260

[22] Filed: Feb. 2, 1982

[51] Int. Cl.[3] ..... C22F 1/00

[52] U.S. Cl. ..... 148/6.2; 148/11.5 A; 148/6.3

[58] Field of Search ..... 148/6.3, 6.2, 11.5 A

[56] References Cited

U.S. PATENT DOCUMENTS 4,312,682 1/1982 Herchenroeder ..... 148/2

*Primary Examiner*—Sam Silverberg

*Attorney, Agent, or Firm*—Jack Schuman; Joseph J. Phillips

[57] ABSTRACT

This invention relates to components of ceramic kiln and furnace hardware made of NICRALY alloys.

Disclosed is a method of heat treating NICRALY alloys to obtain a uniform film of desired alumina ($Al_2O_3$) on the surface of the alloys. The gist of the invention resides in the control of the critical relationship between the temperature and the partial pressure of oxygen in the oxygen potential controlled atmosphere during the heat treatment. Optimum results are obtained when the temperature is about 2100° F. and the dew point is about −30° F. in hydrogen for about one hour.

7 Claims, 2 Drawing Figures

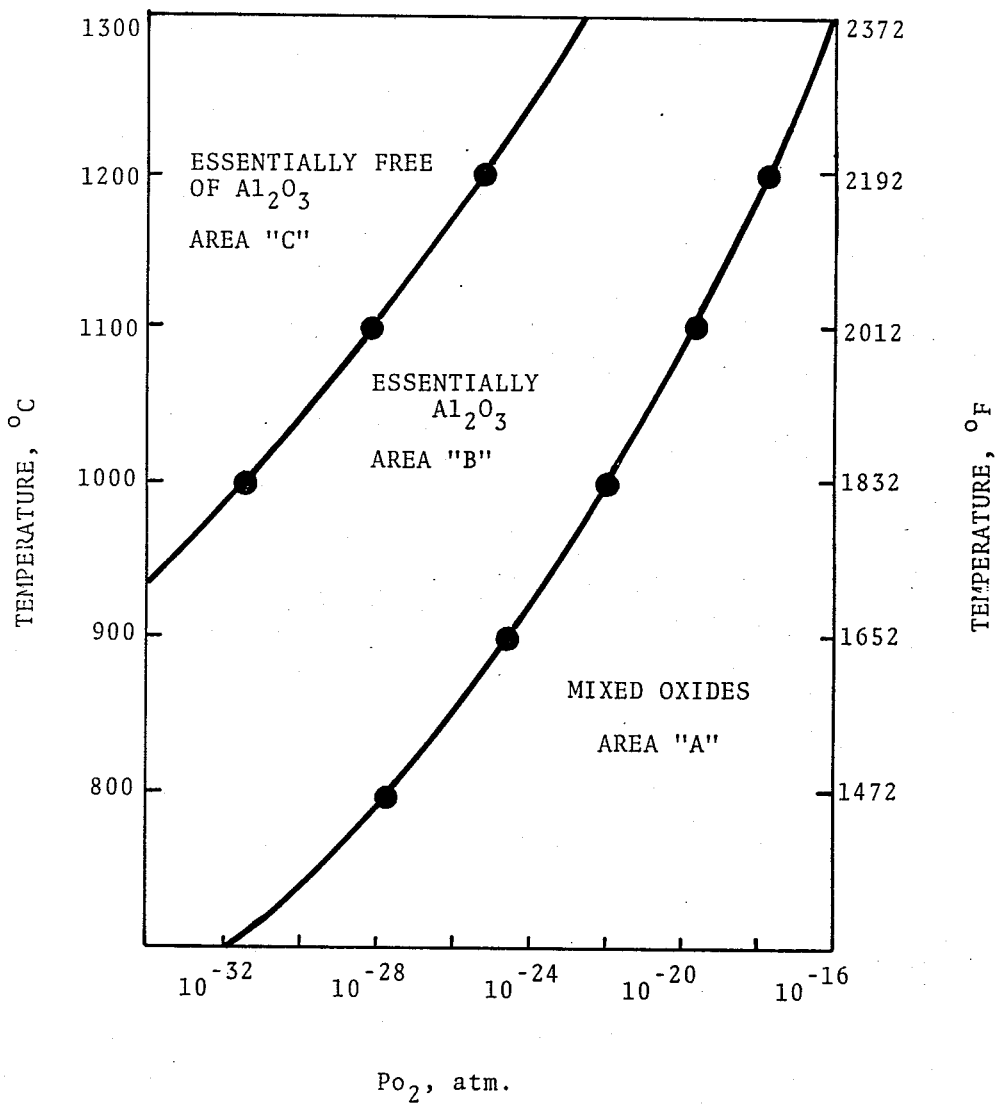
FIGURE 1: AREA OF ESSENTIALLY ALUMINA FORMATION IN RELATION TO OXYGEN POTENTIAL AND EXPOSURE TEMPERATURE.

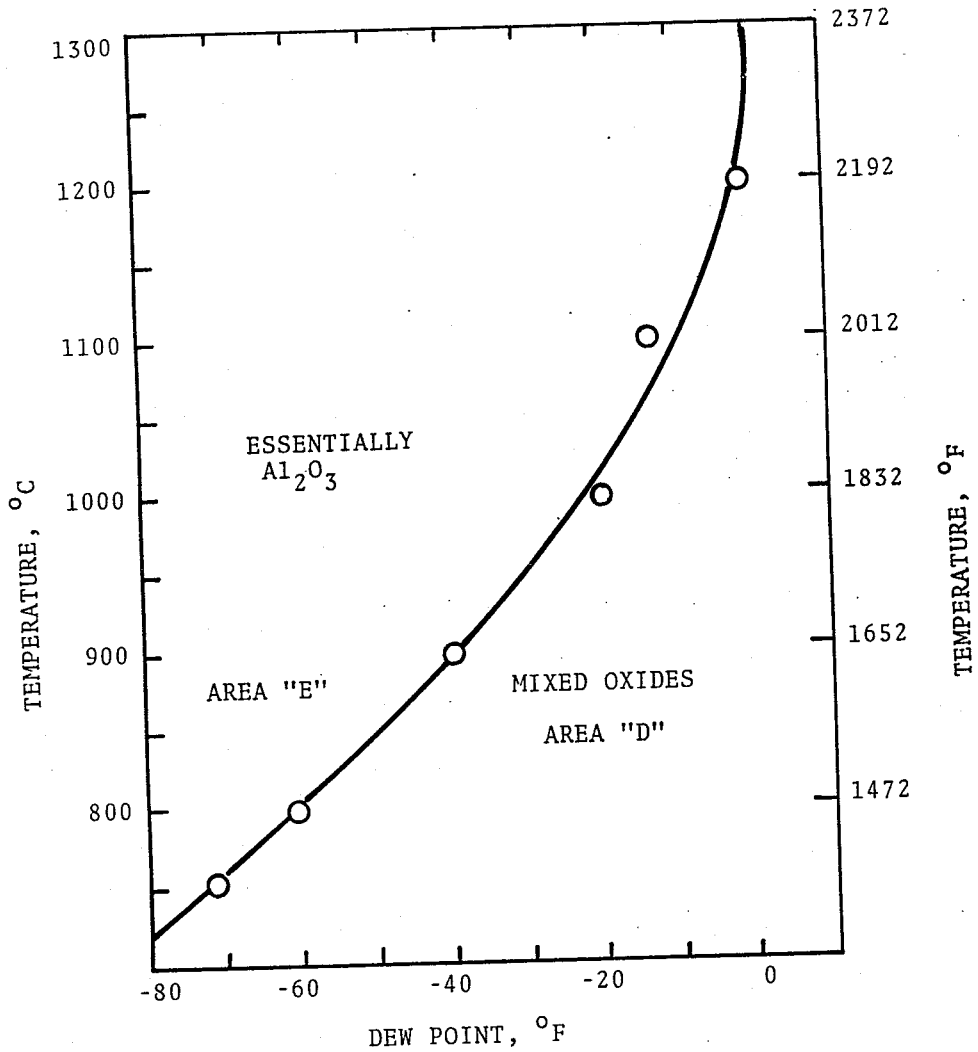
FIGURE 2: AREA OF ESSENTIALLY ALUMINA FORMATION IN RELATION TO DEW POINT AND EXPOSURE TEMPERATURE.

METHOD OF HEAT TREATING NICRALY ALLOYS FOR USE AS CERAMIC KILN AND FURNACE HARDWARE

This invention relates to nickel-base oxidation resistant alloys, particularly to Ni-Cr-Al-Y alloys, and methods of heat treating them for use as accessory kiln or furnace hardware, components and support systems of kilns and heat treating furnaces used in the manufacture of ceramic or metal products. More particularly, it relates to a controlled oxidizing atmosphere during an oxidizing heat treatment of articles for use as ceramic kiln or furnace hardware.

Known in the art is a class of superalloy known as NICRALY, these alloys contain chromium, aluminum and yttrium in a nickel base. Typical alloys of this class are described in many U.S. patents and especially in U.S. Pat. No. 3,754,902. U.S. Pat. No. 4,312,682 discloses the use of NICRALY alloys as ceramic kiln hardware.

In the manufacture of typical ceramic products (often called pottery), the ceramics, clays, and other non-metallic minerals together with associated glazes are usually heated to elevated temperatures three times. The term "ceramic products" (and pottery) as used herein includes earthenware, porcelain, brick, glass, vitreous enamels and like products. The three firing ranges include:

1. "Bisque Firing" which removes impurities of nature and which transforms the clay mixtures into stable chemical compounds. Firing temperatures are typically 2100°-2230° F. (1150°-1220° C.).
2. "Glost Firing" during which the glossy glaze layer is fixed to the ceramic substrate at temperatures of about 1830°-2010° F. (1000°-1100° C.), and
3. "Decorating Operation" during which decals, colors, hand paintings or other decorations are affixed to the pottery. Temperature ranges for these operations are typically about 1380°-1830° F. (750°-1000° C.).

Because the in-process ceramic articles are fragile and cannot stand sudden extreme changes in temperature without cracking, heating cycles typically start at or near ambient temperature, and are slowly raised in the required firing temperature. Typical firing cycles are of the order of 24-48 hours in duration in an oxidizing atmosphere although vacuum or low oxygen potential atmospheres could be utilized.

During the firing operations, the ceramic articles must be supported to maintain proper shape of the articles and to prevent damage to the surfaces, particularly the glazed surfaces of the ware while allowing for movement of the parts and support system because of thermal expansion.

An apparently obvious solution to the above-described difficulties would be a metal support system, and this has, indeed, been unsuccessfully tried.

Stainless steels were tried but, in the long run, the steels lacked sufficient strength and oxidation resistance. High temperature "superalloys" of the nickel-chromium type, for example 80-20 alloys, provided adequate strength levels but left unacceptable discolorations on the finished product, because of interaction of the in-process ceramic articles and ceramic glaze systems with the naturally forming oxides of the alloys investigated. Metal alloys coated with various formulations were also investigated. Inconsistent results and poor reliability resulted. Thus, what seemed to be an obvious, simple solution to the problem of the ceramic industry, in fact, proved to be no solution at all.

In the manufacture of metal or alloy components, it is frequently necessary to heat treat metal parts at high temperature for various reasons such as brazing or to change the metallurgical characteristics of the metals. Often times the components are of such configurations and design that they must be held or supported in place. An example is that of a brazing operation where parts must be positioned during the joining operation. Typical choices for these support systems are either metals, ceramics, or metals on which a ceramic material has been applied. Examples of such systems include pedestals, stilts, cradles and the like.

In the present art, these support systems or "kiln" hardware" are constructed from refractory-type materials into components, which, in turn, require preforming and firing to render them serviceable. The term "kiln hardware" used herein refers to component parts and support systems relating to kilns used in ceramic processing.

These refractory kiln hardware components have numerous faults, shortcomings and disadvantages. They are difficult to make and join, costly, friable, brittle and bulky. Further, the present refractory-type kiln hardware tends to have a short life, in many instances, only one kiln cycle. Furthermore, the ratio of the weight of unsaleable refractory support systems to saleable product typically is about 2:1 and frequently reaches 3:1. When considering the required energy waste of such systems, it becomes imperative to devise and develop more energy efficient methods of producing ceramic products. To achieve the required efficiency, support systems which can be cycled more rapidly and which have less bulk are required. In addition to the energy efficiency required, it is also desirable to reduce the tendency of the systems to suddenly crack and break (often destroying an entire kiln load of product) or simply break during the normal handling of these fragile systems.

The ceramic holders of this instance suffer many of the problems of the ceramic supports in kilns described earlier; i.e. they are fragile, bulky and typically have short service life. Typical metal supports in furnaces have the problem of fusing to the components they support when used in a low oxygen potential furnace atmosphere such as that used for brazing. To prevent this problem, the supports are coated with ceramic. Because of the difference in expansion characteristics of metal and ceramics, these ceramic coatings usually must be cleaned from the supports and new coatings applied for each cycle of heat treatment—a costly and aggravating procedure.

Alloys which form predominantly $Cr_2O_3$ or other chromium rich oxides and which have been used for support systems during brazing frequently have the problem of the oxides being reduced by the atmosphere (viz in $H_2$) or the oxides vaporize in "hard" vacuum. The $Al_2O_3$ scales provided by this invention are free of these problems.

FIG. 1 is a graphic presentation of data determined as part of this invention to define the formation in a general atmosphere with controlled oxygen partial pressure of essentially alumina ($Al_2O_3$) scale described herein on the alloy surface. Such atmosphere may include one or more of hydrogen, argon, helium, carbon dioxide, carbon monoxide and cracked ammonia.

FIG. 2 is a graphic presentation of data points determined as part of this invention to define the formation in a hydrogen atmosphere of an essentially alumina ($Al_2O_3$) scale described herein.

U.S. Pat. No. 4,312,682 discloses the use of NICRALY alloys as components of ceramic kilns. The patent suggests the formation of an oxide scale on the surface of the alloy. It was subsequently discovered that simple exposure in air did not yield consistant uniform results. The oxide surfaces resulting from some oxidation heat treatments were acceptable and some were not acceptable. Causes of such inconsistant results could not be readily determined by obvious modifications within ordinary skills. This situation restricts the full commercial utilization of the new technology.

It is the principal object of this invention to provide a method for the oxidation heat treatment of NICRALY that yields consistant and uniform oxide scale.

It is another object of this invention to provide a heat treatment method that enhances the characteristics of kiln hardware articles.

It is another object of this invention to provide a heat treatment method that enhances the characteristics of furnace hardware articles.

Other objects and aims are apparent in the following specification and claims.

The present invention broadly provides a NICRALY alloy article and an oxidizing heat treatment to make the article eminently suited for use as kiln hardware and furnace hardware.

Through experimentation, it has been discovered that an essentially aluminum oxide scale on an alloy surface is virtually inert to most of the raw material mixtures and glazes in the temperature ranges used by the ceramic industry.

It has additionally been determined that an essentially aluminum oxide scale on an alloy surface will prevent in most instances the diffusion bonding of that alloy to another metallic surface during heat treatment cycles. Further, the scale typically prevents brazing alloys from wetting the surfaces of the supporting alloy. This prevents the joining of the support alloy to the parts being joined. It has been further discovered that alloys of Ni-Cr-Al-Y type provide such an aluminum oxide scale when exposed to high temperatures in an oxidizing atmosphere as described herein, that these scales are essentially self-healing and that the scales or oxides are resistant to spalling, they are not volatile, nor are they easily reduced.

Finally, it has been discovered that the best results have been achieved when the Ni-Cr-Al-Y alloy as been preoxidized at high temperatures to preform the insulating-protective-non-reactive oxide scale prior to contact of the surface with the in-process ceramic or metallic products to be supported.

A series of heat treatments were performed on a NICRALY alloy to establish heating parameters which would adequately form the desired scale interface for use between alloy and the in-process or ceramic or metallic products. A low-oxygen potential, hydrogen-rich atmosphere with a dew point between −70° F. and −10° F., and preferably at −30° F. and at a temperature between about 1850° and 2200° F., was discovered to yield consistently excellent oxide scales. When the alloy is oxidized in an oxygen rich atmosphere, the initial scales are frequently mixed oxides; i.e., a combination of chromium oxides and aluminum oxide i.e. $Cr_2O_3+Al_2O_3$.

The alloys used in these tests were comprised essentially of 15% chromium, 5% aluminum, 0.01% yttrium content and the balance nickel. A working range of these alloys may vary about 10 to 20% chromium, about 3 to 7% aluminum and an effective amount from about 0.005 to 0.04% yttrium and balance nickel plus impurities and modifying elements, provided the modifying elements do not deteriorate the oxide scale that is resistant to discloration of in-process ceramic ware when used as a ceramic support. However, many modifications of the basic NICRALY alloy may be made within the ranges 8 to 25% chromium, 2.5 to 8% aluminum, a small but effective yttrium content not over 0.1% and the balance nickel and impurities plus modifying elements optionally selected from the groups: up to 15% total Mo, Rh, Hf, W, Ta, and Cb; up to 0.5% total C, B, Mg, Zr and Ca; up to 1% Si; up to 2% Mn; up to 20% Co; up to 5% Ti and up to 30% Fe, provided the alloy forms an essentially aluminum oxide scale. The alloys were (1) melted to composition; (2) electroslag remelted (ESR) into shapes for further metal working; and, (3) worked into final shape.

The experimental program to evaluate proper heat treatments resulted in the following basic conclusions.

1. Heat treatment of the subject alloy for one hour at 2100° F. provided an adequate oxide film.
2. The rate of heating to 2100° F. was not critical.
3. Surface grinding the previously annealed alloy to a 120-grit finish and exposing it at 2000° F. in air for seven hours provided only a marginally acceptable oxide film.
4. Simple exposure of the subject alloy at temperatures below 2000° F. in air did not provide an adequate (an essentially aluminum oxide) film. At these temperatures, a mixture of green (presumably $Cr_2O_3$) and silver gray (presumably $Al_2O_3$) oxides formed.
5. Exposure of the subject alloy for 20 minutes at a temperature between 2000° and 2200° F. in flowing argon (a simulated bright anneal treatment) created what appeared to be a film of $Al_2O_3$.

From these results, it is concluded that the subject alloy would achieve the best surface oxide for interface with ceramic or metal parts during firing by being preoxidized in a controlled-oxygen-potential atmosphere at a temperature over about 1850° F., and preferably over about 2100° F., but below the melting temperature of the alloy for a time dependent upon the condition of the alloy surface, and the oxygen potential of the atmosphere.

EXAMPLE NO. 1

Specimens of NICRALY alloy comprising essentially of about 15% chromium, about 5% aluminum, about 0.01% yttrium and the balance nickel plus impurities and modifying elements as defined herein were prepared as described herein. The surfaces of the specimens were cleaned by acid dipping in a nominally 18% $HNO_3+2HF$ aqueous solution and then rinsed and dried. The as-dried specimens were exposed in an oxygen-poor hydrogen-rich atmosphere at 2100° to 2125° F. for one hour. The hydrogen-rich atmosphere had a dew point of −32° F.

The surfaces of the specimens had a grey, essentially alumina ($Al_2O_3$) scale. The specimens produced and heat treated by the process of Example No. 1 has an outstanding degree of good characteristics as required for supports for ceramic ware and alloy supports used during brazing.

As a guide to define a practical specification to obtain the benefits of this invention, the following parameters are suggested.

(1) Controlled oxygen potential atmosphere.

Commercial hydrogen or cracked ammonia typically used for bright annealing or brazing operation, argon, helium, carbon dioxide, carbon monoxide or mixtures of these with controlled oxygen potential may be used; a predominantly hydrogen atmosphere with a low dew point preferably between about −70° F. to about −10° F. is preferred.

(2) Temperature. The temperature may be between about 1500° F. and the melting point of the alloy and preferably between 2100° F. and 2200° F.

(3) Time. The effective time at temperature may be determined as required for specific use. An example is one hour at about 2100° F. and a dew point of about −30° F. in a predominantly $H_2$ atmosphere for general use. Other times may be determined in view of the temperature range and oxygen potential.

To define the invention more clearly, a series of determinations were made to show the relationship between partial oxygen pressure of the controlled atmospheres and temperature to obtain the essentially alumina ($Al_2O_3$) scale. FIG. 1 shows the curves obtained that defines the broad range of this invention. Area B of the graph defines the conditions at which essentially alumina scale forms in this invention; area A of the graph defines an area of mixed oxides, especially, for example, Chromia and Alumina ($Cr_2O_3+Al_2O_3$).

To define the preferred mode of the invention, a series of determinations were made to show the relationships between the dew point of the controlled-oxygen potential, hydrogen-rich atmospheres and temperatures to obtain the essentially alumina ($Al_2O_3$) scale. FIG. 2 show the curve obtained that defines the preferred mode of this invention. Area E of FIG. 2 defines the conditions at which the predominantly alumina scale forms in this invention, Area D defines an area of mixed oxides.

NICRALY alloys may be produced by a variety of processes, powder metallurgy, castings, wrought processes and the like as is well known in the art. It is preferred to produce the alloy by the electroslag remelting (ESR) process, then hot and/or cold roll to the desired article before the critical oxidation step.

While several methods have been described as a result of testing, other modifications may be made within the scope of the invention and within the following claims.

What is claimed is:

1. The method for producing furnace and kiln hardware articles for use in the manufacture of metallic and ceramic products including the steps of:

a. providing an alloy consisting essentially of, in weight percent, 8 to 25 chromium, 2.5 to 8 aluminum, a small but effective yttrium content not exceeding 0.1, and the balance nickel and impurities plus modifying elements optionally selected from the groups; up to 15 total Mo, Rh, Hf, W, Ta and Cb; up to 0.5 total C, B, Mg, Zr and Ca; up to 1 Si, up to 2 Mn, up to 20 Co, up to 5 Ti, and up to 30 Fe, and b. fashioning said alloy into said article with a required shape for said use, and characterized by heat treating said fashioned article for an effective time in an oxygen potential controlled atmosphere with an oxygen partial pressure and between about 1500° and 2372° F. as indicated in area "B" in the attached FIG. 1 to provide an essentially aluminum oxide film on the surface of said article.

2. The process of claim 1 wherein the controlled oxygen potential atmosphere consists essentially of at least one of the group hydrogen, argon, helium, carbon monoxide and carbon dioxide.

3. The method for producing a kiln hardware article for use in the manufacture of ceramic products including the steps of:

a. providing an alloy consisting essentially of, in weight percent, 8 to 25 chromium, 2.5 to 8 aluminum, a small but effective yttrium content not exceeding 0.1, and the balance nickel and impurities plus modifying elements optionally selected from the groups; up to 15 total Mo, Rh, Hf, Ta and Cb; up to 0.5 total C, B, Mg, Zr and Ca; up to 1 Si, up to 2 Mn, up to 20 Co, up to 5 Ti, and up to 30 Fe, and b. fashioning said alloy into said article with a required shape for said use, and characterized by heat treating said fashioned article for an effective time in a hydrogen-rich atmosphere with a dew point and between about 1500° and 2372° F. as indicated as Area "E" in the attached FIG. 2 to provide an essentially aluminum oxide film on the surface of said article.

4. The process of claim 3 wherein the atmosphere contains at least 85% hydrogen and wherein the dew point is about −70° F. to about −10° F.

5. The process of claim 3 wherein the temperature is between about 1500° F. and 2225° F.

6. The process of claim 3 wherein the hydrogen-rich atmosphere has a dew point of about −30° F. and the temperature is between about 2000° and 2200° F.

7. The process of claim 1 wherein the temperature is between about 1500° and 2225° F.

* * * * *